US007892050B2

(12) United States Patent
Pavlovic et al.

(10) Patent No.: US 7,892,050 B2
(45) Date of Patent: Feb. 22, 2011

(54) HIGH POWER FUSE TERMINAL WITH SCALABILITY

(75) Inventors: Slobodan Pavlovic, Novi, MI (US); David Menzies, Linden, MI (US); Michael Glick, Farmington Hills, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 12/797,735

(22) Filed: Jun. 10, 2010

(65) Prior Publication Data

US 2010/0323563 A1 Dec. 23, 2010

Related U.S. Application Data

(60) Provisional application No. 61/187,887, filed on Jun. 17, 2009.

(51) Int. Cl.
*H01R 13/15* (2006.01)

(52) U.S. Cl. ..... 439/839; 439/857; 439/620.26; 439/250

(58) Field of Classification Search ..... 439/620.26, 439/839, 857, 250
See application file for complete search history.

(56) References Cited

U.S. PATENT DOCUMENTS

| | | | | |
|---|---|---|---|---|
| 2,774,951 | A | 12/1956 | Kinkaid et al. | |
| 2,921,287 | A | 1/1960 | Matthysse et al. | |
| 3,550,069 | A | 12/1970 | Teagno | |
| 4,351,583 | A * | 9/1982 | Belttary | 439/839 |
| 4,553,808 | A | 11/1985 | Weidler et al. | |
| 4,570,147 | A | 2/1986 | Ebi | |
| 4,646,052 | A | 2/1987 | Matsunaga et al. | |
| 4,672,352 | A | 6/1987 | Takano | |
| 4,751,490 | A | 6/1988 | Hatagishi | |
| 4,869,972 | A | 9/1989 | Hatagishi | |
| 4,871,990 | A | 10/1989 | Ikeda et al. | |
| 4,932,877 | A * | 6/1990 | Zinn | 439/839 |
| 4,958,426 | A | 9/1990 | Endo et al. | |
| 5,094,636 | A * | 3/1992 | Zinn et al. | 439/839 |
| 5,147,230 | A | 9/1992 | Plyler et al. | |
| 5,226,842 | A | 7/1993 | Endo et al. | |
| 5,350,321 | A | 9/1994 | Takenouchi | |
| 5,416,461 | A | 5/1995 | Totsuka et al. | |
| 5,427,552 | A | 6/1995 | Zielinski et al. | |
| 5,488,346 | A | 1/1996 | Kondo et al. | |
| 5,581,225 | A | 12/1996 | Oh et al. | |
| 5,679,034 | A | 10/1997 | Hanazaqki et al. | |
| 5,688,174 | A | 11/1997 | Kennedy | |
| 5,716,245 | A | 2/1998 | Kameyama et al. | |
| 5,745,024 | A | 4/1998 | Ohta et al. | |
| 7,595,715 | B2 * | 9/2009 | Pavlovic et al. | 337/198 |

* cited by examiner

*Primary Examiner*—Tho D Ta
(74) *Attorney, Agent, or Firm*—MacMillan, Sobanski & Todd, LLC

(57) ABSTRACT

A female terminal receptor for an automotive fuse or a terminal includes three or more pairs of opposing beams and at least one U-shaped clamping member. The U-shaped clamping member has a first base portion laterally disposed between two pairs of opposing beams and at least one pair of first end portions disposed over at least one pair of opposing beams for applying a predetermined compression force. The opposing beams have a first metallic composition and the U-shaped clamping member has a second metallic composition, wherein the first metallic composition has a higher conductivity than the second metallic composition, and wherein the second metallic composition has a higher relaxation temperature than the first metallic composition.

14 Claims, 7 Drawing Sheets

HIGH POWER FUSE TERMINAL WITH SCALABILITY

CROSS REFERENCE TO RELATED APPLICATIONS

The present application claims priority to provisional application Ser. No. 61/187,887, filed Jun. 17, 2009, entitled "High Power Terminal; Scaleable Design."

STATEMENT REGARDING FEDERALLY SPONSORED RESEARCH

Not Applicable.

BACKGROUND OF THE INVENTION

The present invention relates in general to terminals for high power automotive fuses and electrical connectors, and, more specifically, to a scalable terminal design for adjusting current-carrying capacity.

High-power fuse assemblies for power distribution boxes used in automotive vehicles commonly include a fuse body with a nonconductive housing encasing a conductive set of female terminals. The set of female terminals are each connected to a respective end of a fuse element retained in the housing. The female terminals are inserted over a set of male blade terminals extending from a power distribution box for completing an electrical circuit. The female terminals are typically designed with a spring-type feature to maintain a strong electrical contact with the male terminal blades. If the current flow in the electrical circuit increases above a predetermined current threshold, the fuse element will open, thereby terminating current flow across the respective set of female terminals. Spring-type female terminals are also used for other types of connections to male blade terminals, such as a connection from a wiring harness to an electrical device.

Copper has good electrical conductivity properties, and has been a preferred material for the terminals. However, copper is susceptible to relaxation (i.e., loss of spring force) as the temperature increases. Since temperature of the terminals increases as the current drawn in the electrical circuit increases, copper terminals have a reduced ability to maintain strong clamping force onto the male terminal blades. Relaxation of the female terminals decreases the overall contact area with the male blades, resulting in reduced electrical conductivity, increased resistance, and a further increase in temperature.

It is desirable to keep the overall size of an electrical distribution box or other connectors as small as possible while still providing the necessary current-carrying capacity. For any particular size of a fuse, the thickness and width of the female terminals is correspondingly limited. Therefore, the spring force cannot be further increased by simply making the terminals thicker or wider. When copper is used, the size limitations may make the desired spring force unattainable. Consequently, copper alloys for which relaxation does not occur until higher temperatures are reached have been used. On the other hand, copper alloys typically have a lower conductivity. For any particular size (i.e., volume) of fuse, the current capacity is thus reduced. In automotive applications, fuses using copper alloys are typically limited to 60 amps or less.

Commonly assigned U.S. Pat. No. 7,595,715 discloses an improved terminal system wherein a high conductivity material with a relatively low relaxation temperature (e.g., copper) is used for the current-carrying legs of a female terminal while a separate spring element with a relatively high relaxation temperature clamps the legs to the male terminal blades. It would be desirable to further increase current carrying capacity and to simplify design and development of female terminals employing legs and spring elements.

SUMMARY OF THE INVENTION

In one aspect of the invention, an automotive fuse is provided for coupling to a power distribution box, wherein the power distribution box includes first and second blade terminals. The fuse comprises a first terminal receptor including three or more pairs of first opposing beams and at least one first U-shaped clamping member. Each pair of first opposing beams spreads apart to receive the first blade terminal. The first U-shaped clamping member has a first base portion laterally disposed between two pairs of first opposing beams and at least one pair of first end portions disposed over at least one pair of first opposing beams for applying a predetermined compression force. A second terminal receptor includes three or more pairs of second opposing beams and at least one second U-shaped clamping member. Each pair of second opposing beams spreads apart to receive the second blade terminal. The second U-shaped clamping member has a second base portion laterally disposed between two pairs of second opposing beams and at least one pair of second end portions disposed over at least one pair of second opposing beams for applying the predetermined compression force. The opposing beams have a first metallic composition and the U-shaped clamping members have a second metallic composition, wherein the first metallic composition has a higher conductivity than the second metallic composition, and wherein the second metallic composition has a higher relaxation temperature than the first metallic composition.

DETAILED DESCRIPTION OF PREFERRED EMBODIMENTS

Figure 1:
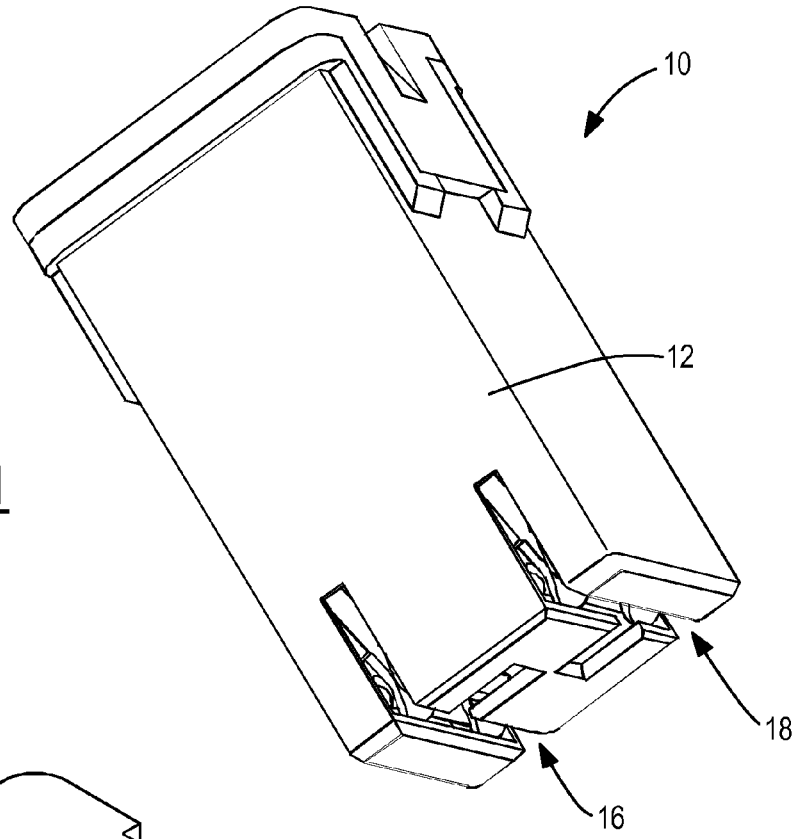
FIG. 1 is a perspective view of a fuse.

Referring now to the drawings, there is illustrated in FIG. 1 a high power fuse shown generally at 10. The high power fuse 10 includes a housing 12 and a fuse assembly 14 disposed within the housing 12. The housing 12 includes a first slot 16 for receiving a first terminal blade and a second slot 18 for receiving a second terminal blade.

Figure 2:
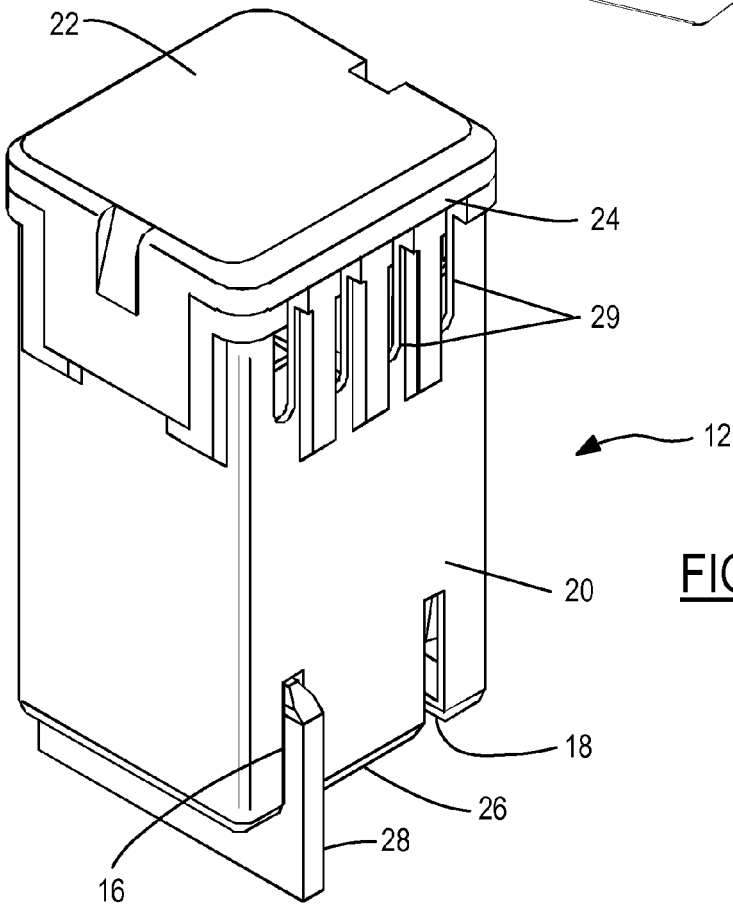
FIG. 2 is a perspective view of a fuse housing.

FIG. 2 is a perspective view of the housing 12. The housing 12 is preferably produced from two sections that include a body portion 20 and a lid portion 22. The body portion 20 is an elongated chamber that includes an open end 24 and a closed end 26. The open end 24 is of a sufficient width and length for receiving and housing the fuse assembly 14 (shown in FIG. 3) within the housing 12. The first slot 16 and the second slot 18 are formed in the closed end 26. The slots are aligned with respective receiving members for making an electrical connection with a respective terminal blade (shown generally at 28).

The lid portion 22 attaches to the open end 24 for enclosing the fuse assembly 14 therein. The housing 12 isolates a person or other objects from the fuse assembly 14 within the housing 12 which may otherwise result in an electrical shock to a person contacting the exposed fuse or a short circuit. The body portion 20 includes ventilation slots 29 formed near the closed end 26 of the body portion 20. As heat is generated by the fuse assembly 14 enclosed within the housing 12, the ventilation slots 29 formed near the top of the body portion 20 provide ventilation (e.g., a chimney effect) for dissipating the heat generated by the fuse assembly 14.

Figure 3:
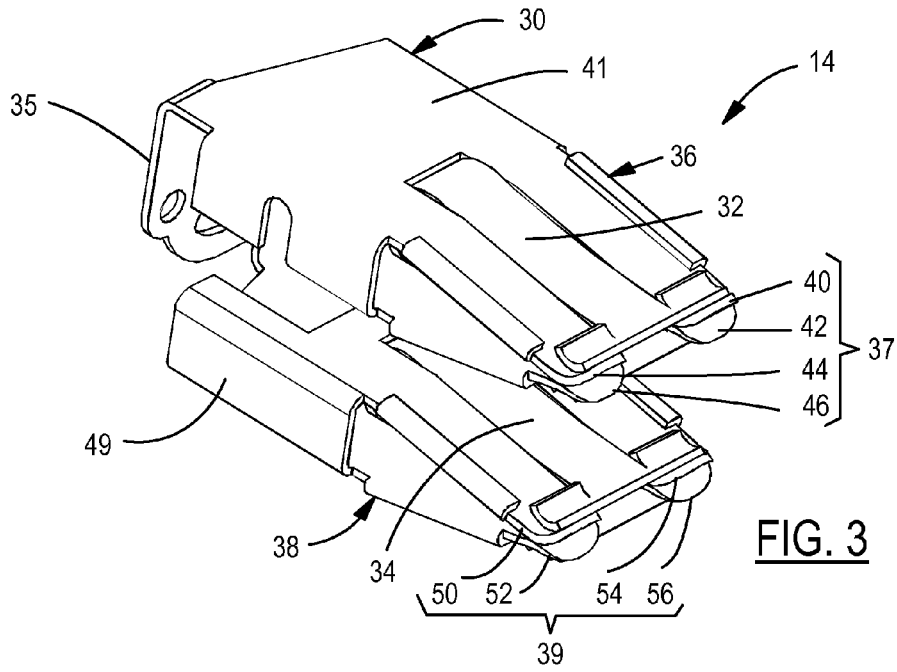
FIG. 3 is a perspective view of a fuse assembly.

FIG. 3 illustrates the fuse assembly 14. The fuse assembly 14 includes a fuse body 30, a first clamp-like member 32, and a second clamp-like member 34. The fuse body 30 is preferably made from a single piece of stamped metal such as copper. The fuse body 30 includes a fuse element 35, a first terminal receptor 36 for receiving is a respective male terminal blade (not shown), and a second terminal receptor 38 for receiving respective male terminal blade (not shown). The fuse element 35 is integrally formed between the first terminal receptor 36 and the second terminal receptor 38. The fuse element 35 is produced from the same material as the first terminal receptor 36 and the second terminal receptor 38. In addition, fuse element 35 is plated with a second material, such as tin, that when heated, diffuses into the copper which lowers the melting point of the copper. At a predetermined current draw (corresponding to a predetermined temperature), the tin begins to diffuse into the copper and the diffused portion of the copper begins to melt thereby creating an open circuit within the fuse element 35 for terminating current flow between the first terminal receptor 36 and the second terminal receptor 38.

Figure 4:
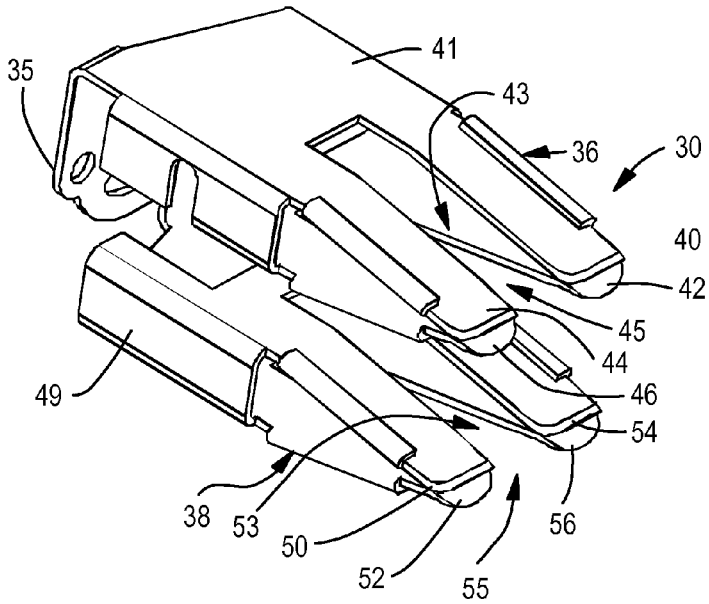
FIG. 4 is a perspective view of a fuse body.

FIG. 4 illustrates a fuse body 30 without the respective clamp-like members. The first terminal receptor 36 includes a body portion 41 having a first set of terminal legs 37 extending from the body portion 41. The body portion 41 is preferably a non-resilient section that conductively couples the fuse element 35 to the first set of terminal legs 37. The first set of terminal legs 37 includes a first leg 40 and a second leg 42 opposing one another. The first set of terminal legs 37 further includes a third leg 44 and a fourth leg 46 opposing one another and positioned adjacent to the first leg 40 and the second leg 42, respectively. The first leg 42 and the third leg 44 are in spaced relation to one another having a respective space 43 therebetween. The second leg 42 and the fourth leg 46 are in spaced relation to one another having a respective space 45 therebetween. Each of the respective legs are resilient for maintaining a compression force on a respective terminal blade received between the first and second legs 40 and 42 and the second and third legs 44 and 46.

The second terminal receptor 38 includes a body portion 49 having a second set of terminals legs 39 extending from the body portion 49. The second set of terminal legs 39 includes a first leg 50 and a second leg 52 opposing one another. The second set of terminal legs 38 further includes a third leg 54 and a fourth leg 56 opposing one another and positioned adjacent to the first leg 50 and the second leg 52. The first leg 50 and the third leg 54 are in spaced relation to one another having a respective space 53 therebetween. The second leg 52 and the fourth leg 56 are in spaced relation to one another having a respective space 55 therebetween. Each of the respective legs are resilient for maintaining a compression force on a respective terminal blade received between the first and second legs 50 and 52 and the second and third legs 54 and 56.

The first clamp-like member 32 is assembled to the fuse body 30 for applying a predetermined compression force against the first set of terminal legs 36. The first clamp-like member 32 is mounted to the first terminal receptor 36 centrally located between the first set of terminal legs 37 within the respective spaces 43 and 45. The first clamp-like member 32 is configured to secure a respective terminal blade between the first set of terminal legs 36 for maintaining a respective contact area during elevated temperatures.

Figure 5:
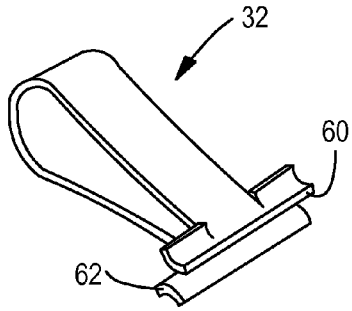
FIG. 5 is a perspective view of a clamp-like member.

FIG. 5 illustrates the clamp-like member 32. The first clamp-like member 32 is a substantially U-shaped body having a first end portion 60 and a second end portion 62. The first end portion 60 and the second end portion 62 can be arc-shaped. The first end portion 60 and the second end portion 62 approach one another as the respective legs of the U-shaped body extend away from the curved base portion of member 32 where the respective legs meet.

Referring again to FIG. 3, when the first clamp-like member 32 is mounted to the first set of terminal legs 37, the first end portion 60 contacts an exterior section of the first leg member 40 and third leg member 44. In addition, the second end portion 62 of the first clamp-like member 32 contacts an exterior section of the second leg member 42 and the fourth leg member 46 thereby holding the first and third leg members 40 and 44 in compression with second and fourth leg members 42 and 46, respectively. The first leg member 40 and the third leg member 44 have respective end sections for nesting the first end portion 60 of the first clamp-like member 32 for preventing sliding movement between the first and third leg members 40 and 44 and the first end portion 60. This provides a seating engagement between first and third leg members 40 and 44 and the first end portion 60. Similarly, the second leg member 42 and the fourth leg member 46 have respective end sections for nesting the second end portion 62 of the second clamp-like member 34 for preventing sliding movement between the second and fourth leg members 42 and 46 and the second end portion. This provides a seating engagement between second and fourth leg members 42 and 46 and the second end portion 62.

The first clamp-like member 32 is made of stainless steel which has low relaxation properties at elevated temperatures. As a result, the first clamp-like member 32 prevents the respective terminal legs from relaxing at elevated temperatures which would otherwise reduce the contact area with an associated blade terminal. As a result, the need for utilizing a copper alloy or similar substitute of material with lesser conductive properties is not necessary since relaxation has been minimized. Therefore, a higher conductive material, such as copper (C151), forms the fuse body 30.

Similarly, the second clamp-like member 34 is mounted on the fuse body 30 for applying a predetermined compression force against the second set of terminal legs 38. The second clamp-like member 34 is configured to secure a respective terminal blade between the first set of terminal legs 38 for maintaining a respective contact area during elevated temperature increases. The second clamp-like member 34 is mounted to the second terminal receptor 38 centrally located between the second set of terminal legs 38 within the respective spaces 43 and 45.

A first end portion of the second clamp-like member 34 contacts an exterior portion of the first leg member 50 and third leg member 54. In addition, a second end portion of the second clamp-like member 34 contacts an exterior portion of the second leg member 52 and fourth leg member 56 thereby holding the first and third leg member 50 and 54 in compression with second and fourth leg member 52 and 56, respectively.

The first leg member 50 and the third leg member 54 have respective end sections for nesting the first end portion of the second clamp-like member 34 for preventing sliding movement between the first and third leg members 50 and 54 and the first end portion. This provides a seating engagement between first and third leg members 50 and 54 and the first end portion of the second clamp-like member 34. Similarly, the second leg member 52 and the fourth leg member 56 have respective end sections for nesting the second end portion of the second clamp-like member 34 for preventing sliding movement between the second and fourth leg members 52 and 56 and the second end portion. This provides a seating engagement between second and fourth leg members 52 and 56 and the second end portion of the second clamp-like member 34.

The second clamp-like member 34 is made of stainless steel which has low relaxation properties at elevated temperatures. As a result, the second clamp-like member 34 prevents the respective terminal legs from relaxing which could otherwise reduce the contact area with an associated blade terminal. Alternatively, the first and second clamp-like members 32 and 34 may be made of a material other than stainless steel so long as material has less relaxation at elevated temperatures in comparison to the material forming the terminal legs.

The contact area of the electrical coupling of the respective leg members and the respective blade terminals is maintained during elevated temperatures as a result of the normal force applied by the first and second clamp-like member. This results in decreased resistance between the mating terminals which further results in increased conductivity at the respective electrical coupling. As described earlier, high power fuses are typically limited to 60 amps maximum due conductive properties of the copper alloy which is used to prevent relaxation at elevated temperatures. The use of the clamp-like members as described in the present invention allows the fuse body to be made of material with a higher copper content and having higher conductivity than copper alloy, allowing a particular fuse size to obtain an increased current rating at elevated temperatures. For example, a respective fuse body made from substantially 0.4 mm of copper stock for a typical fuse footprint area could handle up to 80 amps. A respective fuse body made from substantially 0.6 mm of copper stock fitting using the same respective footprint could handle up to 100 amps.

Figure 6:
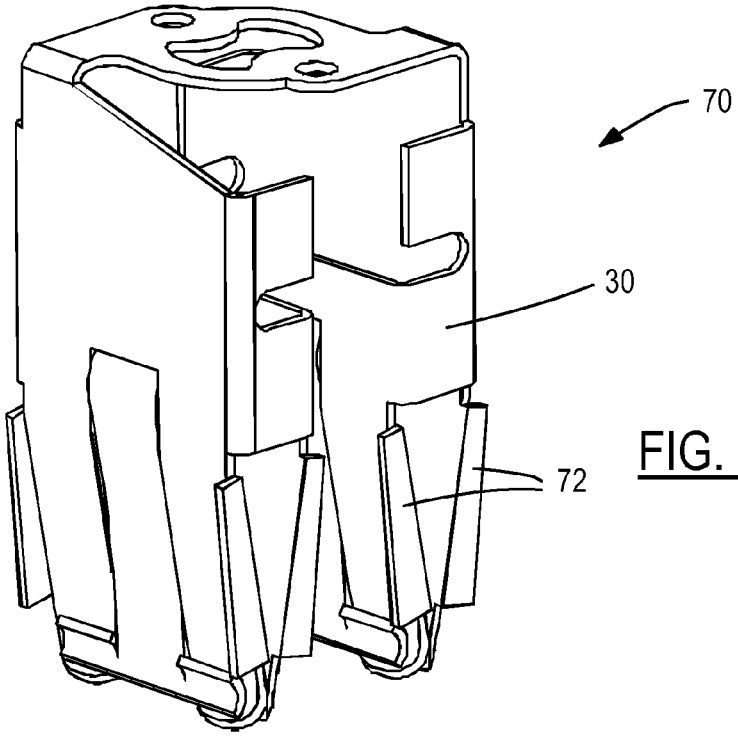
FIG. 6 is a perspective view of another fuse assembly.

FIG. 6 illustrates a high power fuse assembly according to a second preferred embodiment. The fuse assembly 70 includes a plurality of heat sinks 72 for dissipating heat within the fuse body 30. The plurality of heat sinks 72 includes a plurality of fins integrally formed as part of the respective leg members of the fuse body 30. The plurality of fins is positioned so as to allow air to pass over the plurality of fins thereby dissipating heat from the fuse body 30.

Figure 7:
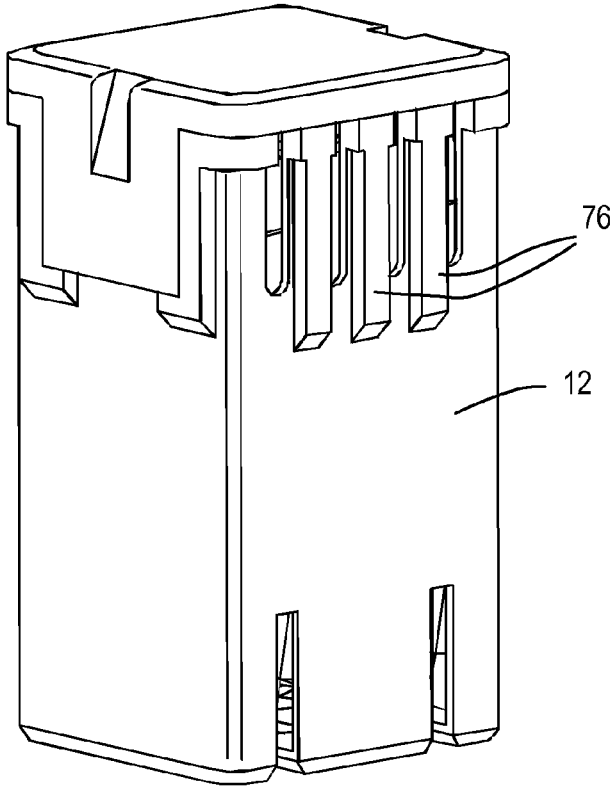
FIG. 7 is a perspective view of another fuse housing.

FIG. 7 illustrates a housing 12 according to a third preferred embodiment. The housing 12 may be made of a plastic polymer that is thermally conductive. A plurality of cooling fins 76 may be formed an the exterior surface of the housing 12 such that heat thermally conducted through the plastic material is dissipated by the air as it flows over the plurality of cooling fins 76.

The present invention facilitates making fuses and connectors with increased current carrying capacity, increased mounting stability, and increased normal forces retaining female terminal receptors on male blade terminals. These improvements are accomplished with a scalable design in which pairs of contact beams are increased above the number shown in the embodiments of FIGS. 1-7. More specifically, each terminal receptor (made of high conductivity material) is provided with three or more pairs of opposing beams. When the overall width of a fuse is increased in order to increase current carrying capacity, rather than just increasing the width of each of the legs in the two pairs of terminal legs as show in FIGS. 1-7, the present invention can in some embodiments use a greater number of beam or leg pairs together with an increase in overall width of the fuse or connector. For example, by modularly expanding from two beam pairs to four beam pairs of the same individual widths, the present invention doubles the maximum current carrying capacity of the fuse/connector while maintaining high normal force on all eight of the individual beams. The present invention also contemplates the use of three or more pairs of opposing beams even when the overall width of the fuse/connector is not increased. In that instance, the additional beam pairs result in greater stability and improved normal forces from the clamping elements. In the most preferred embodiments, the opposing beams all have substantially the same width and are evenly spaced. The present invention further uses a modularly expandable design for the clamping members so that they can be easily integrated onto the terminal receptors.

Figure 8:
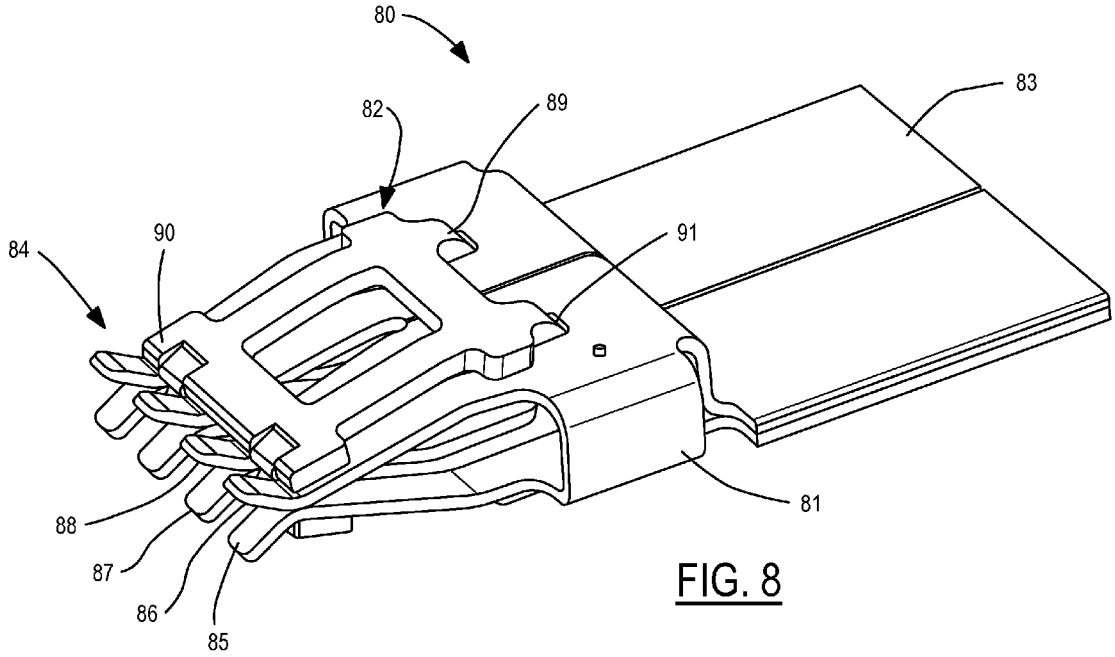
FIG. 8 is a perspective view of a female terminal receptor with an increased number of pairs of opposing beams, according to one embodiment of the invention.
Figure 9:
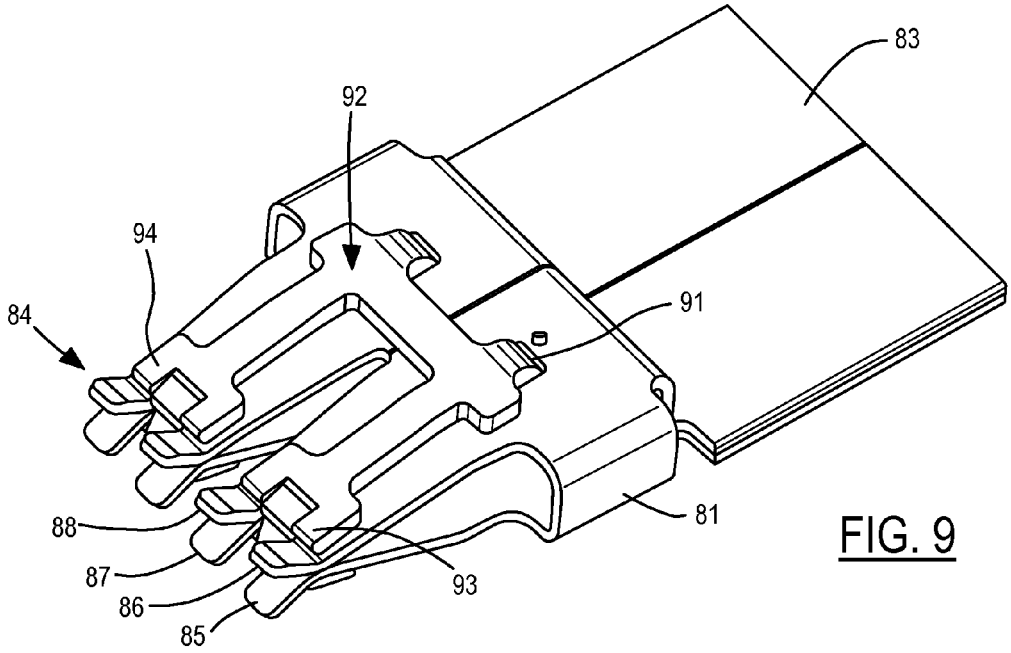
FIG. 9 is a perspective view of a terminal receptor with an alternate clamping member.
Figure 10:
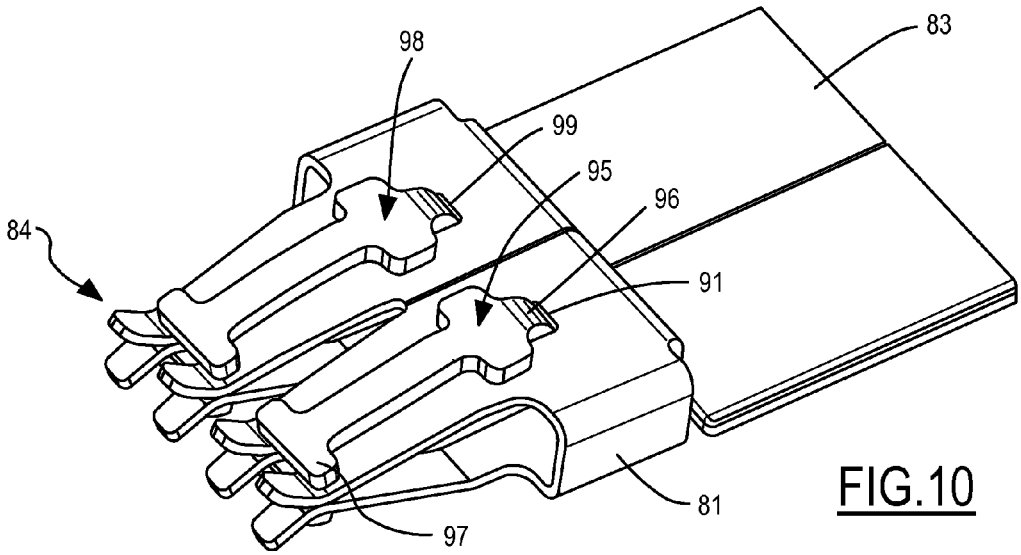
FIG. 10 is a perspective view of a terminal receptor with another alternate clamping member.

Referring now to FIG. 8, a female terminal receptor 80 has a body 81 formed with a termination area 83 at one end and a plurality of pairs of opposing beams 84 at the other end. Each pair of first opposing beams 84 spreads apart to receive the blade terminal of the power distribution box. A clamping member 82 is U-shaped has a base portion 89 which is laterally disposed between at least two pairs of the opposing beams 84 at a recess 91 formed between adjacent beam pairs. Clamping member 82 has at least one end portion 90 disposed over at least one of the opposing beams for applying a predetermined compression force. Beam pairs 84 include beam pair 85, beam pair 86, beam pair 87, and beam pair 88. FIGS. 8-10 show a single terminal receptor by itself, as would be used for a simple connector. Termination area 83 would be connected to a wire or other conductor by crimping, welding, or other known methods. In the case of a fuse, termination area 83 would be joined with another terminal receptor to form a fuse in the same manner as shown in FIGS. 1-7.

Body 81 and opposing beam pairs 84 have a first metallic composition and U-shaped clamping member 82 has a second metallic composition, wherein the first metallic composition has a higher conductivity than the second metallic composition, and wherein the second metallic composition has a higher relaxation temperature than the first metallic composition. The first metallic composition may consist of any desirable high conductivity material, and may preferably consist of nearly pure copper (e.g., copper C102) or copper with trace amounts of other substances (e.g., copper C151 which includes about 0.1% zirconium). The second metallic composition may consist of stainless steel, such as SS301 which includes about 17% chromium, 10% carbon, 7% nickel, and the remainder is iron.

The geometry of the opposing pairs of beams and the geometry of the clamping members are designed to optimize normal forces and the contact area obtained between the terminal receptors and the blade terminals. Instead of all the normal forces being provided by the clamping members, the opposing beams are configured to apply an inward normal force against the blade terminals so that the opposing beams do not subtract from the normal forces provided by the clamping members. In other words, the opposing beams must spring open in order to receive the male blade terminal so that the normal forces of the opposing beams are against the male blade terminal and not against the clamping member. More specifically, the blade terminals have a first predetermined thickness. Each pair of opposing beams is separated by less than the first predetermined thickness while in their rest positions, so that the opposing beam would spread apart to receive the blade terminals even if the clamping members were not in place. Each pair of opposing beams has a second aggregate thickness where they are contacted by the respective end portions of the clamping members (e.g., twice the thickness of the stainless steel sheet used to form the clamping members). The end portions disposed over respective opposing beams are separated by less than the sum of the first predetermined thickness and the second aggregate thickness while in their rest positions (i.e., before they are assembled over the opposing beam pairs).

FIG. 9 illustrates an alternative embodiment of the clamping member used with four opposing beam pairs. Clamping member 92 has individually projecting legs with separate end portions 93 and 94, wherein the projecting legs are joined near the base portion of clamping member 92. Each end portion provides clamping for two of the opposing beam pairs of the terminal receptor.

FIG. 10 illustrates the use of more than one clamping member. Thus, a clamping member 95 with a base portion 96 and an end portion 97 is mounted in a recess 91 between the corresponding pairs of opposing beams. Likewise, a clamping member 98 is mounted in a recess 99 between other corresponding pairs of opposing beams.

Figure 11:
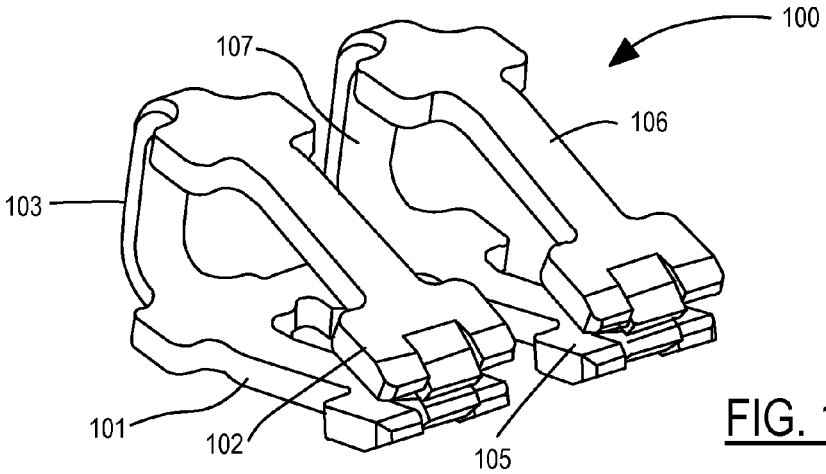
FIGS. 11 and 12 are perspective views of one embodiment of the clamping member.
Figure 12:
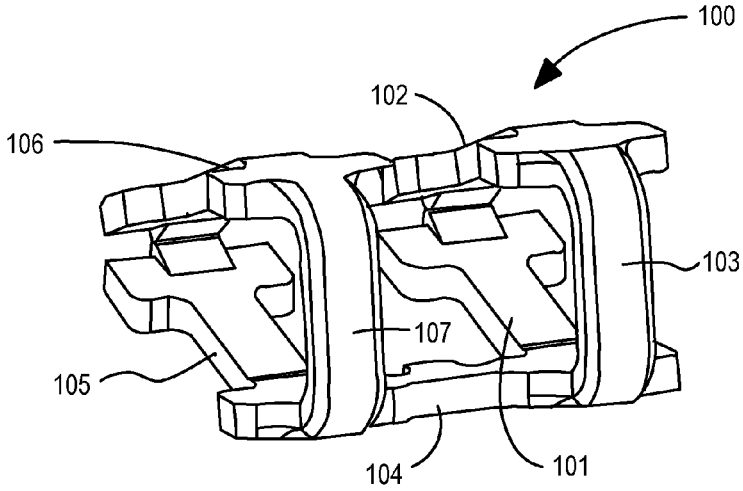

FIGS. 11 and 12 show one embodiment of a clamping member 100 in greater detail. First leg 101 and second leg 102 are joined by a base portion 103. A cross member 104 connects base portion 103 with another base portion 107, from which third leg 105 and fourth leg 106 extend.

Figure 13:
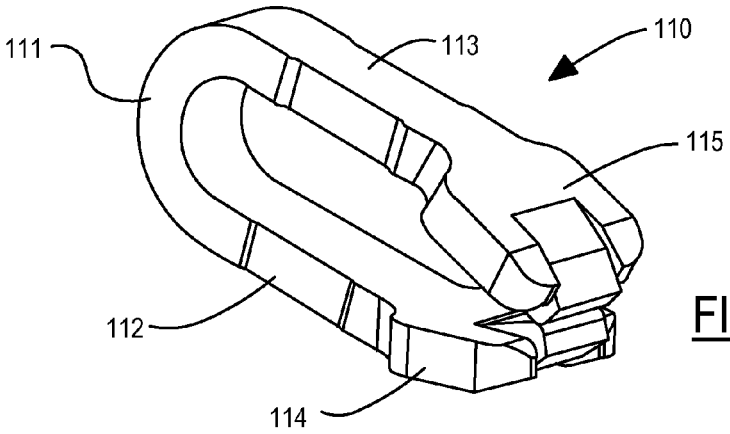
FIG. 13 is a perspective view of another embodiment of the clamping member.

FIG. 13 shows a clamping member 110 with a base portion 11 and legs 112 and 113. End portions 114 and 115 have a width selected to extend over two adjacent pairs of opposing beams. Using a clamping member that fits between just two adjacent beam pairs, any total number of beam pairs on a terminal receptor can be accommodated by selecting a matching combination of clamping members.

Figure 14:
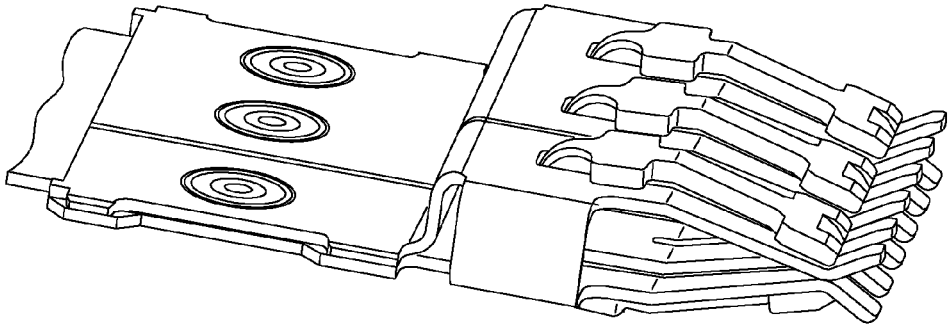
FIGS. 14 and 15 are perspective views of a terminal receptor having six pairs of opposing beams.
Figure 15:
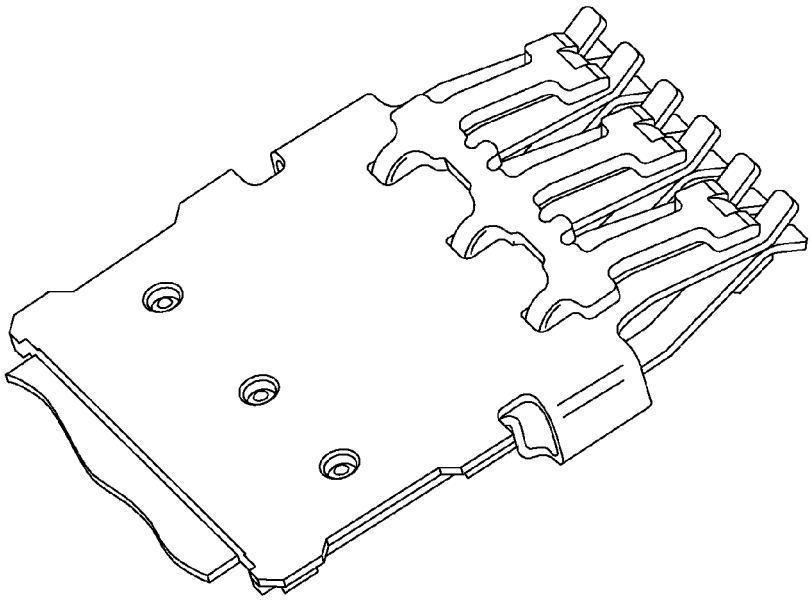

FIGS. 14 and 15 illustrate a terminal receptor having three pairs of opposing beams. Three clamping members of the type shown in FIG. 13 are used.

What is claimed is:

1. An automotive fuse for coupling to a power distribution box, wherein the power distribution box includes first and second blade terminals, the fuse comprising:

a first terminal receptor including three or more pairs of first opposing beams and at least one first U-shaped clamping member, wherein each pair of first opposing beams spreads apart to receive the first blade terminal, wherein the first U-shaped clamping member has a first base portion laterally disposed between two pairs of first opposing beams and at least one pair of first end portions disposed over at least one pair of first opposing beams for applying a predetermined compression force; and a second terminal receptor including three or more pairs of second opposing beams and at least one second U-shaped clamping member, wherein each pair of second opposing beams spreads apart to receive the second blade terminal, wherein the second U-shaped clamping member has a second base portion laterally disposed between two pairs of second opposing beams and at least one pair of second end portions disposed over at least one pair of second opposing beams for applying the predetermined compression force;

wherein the opposing beams have a first metallic composition and the U-shaped clamping members have a second metallic composition, wherein the first metallic composition has a higher conductivity than the second metallic composition, and wherein the second metallic composition has a higher relaxation temperature than the first metallic composition.

2. The automotive fuse of claim 1 wherein the opposing beams all have substantially the same width and are evenly spaced.

3. The automotive fuse of claim 1 wherein the first metallic composition comprises copper.

4. The automotive fuse of claim 1 wherein the first metallic composition comprises an alloy of copper with about 0.1% zirconium.

5. The automotive fuse of claim 1 wherein the second metallic composition comprises stainless steel.

6. The automotive fuse of claim 1 wherein the first and second U-shaped clamping members are each comprised of two or more separate spring members retained between different pairs of opposing beams.

7. The automotive fuse of claim 1 wherein the first and second blade terminals have a first predetermined thickness, wherein each pair of opposing beams is separated by less than the first predetermined thickness while in their rest positions, wherein each pair of opposing beams have a second aggregate thickness in the area where they are contacted by respective end portions, and wherein the end portions disposed over respective opposing beams are separated by less than the sum of the first predetermined thickness and the second aggregate thickness while in their rest positions.

8. A female terminal for an electrical connector for connecting to a male blade terminal, comprising:

a first terminal receptor including three or more pairs of opposing beams; and at least one first U-shaped clamping member, wherein each pair of opposing beams spreads apart to receive the blade terminal, wherein the first U-shaped clamping member has a base portion laterally disposed between two pairs of opposing beams and at least one pair of end portions disposed over at least one pair of opposing beams for applying a predetermined compression force, wherein the opposing beams have a first metallic composition and the U-shaped clamping member has a second metallic composition, wherein the first metallic composition has a higher conductivity than the second metallic composition, and wherein the second metallic composition has a higher relaxation temperature than the first metallic composition.

9. The female terminal of claim 8 wherein the opposing beams all have substantially the same width and are evenly spaced.

10. The female terminal of claim 8 wherein the first metallic composition comprises copper.

11. The female terminal of claim 8 wherein the first metallic composition comprises an alloy of copper with about 0.1% zirconium.

12. The female terminal of claim 8 wherein the second metallic composition comprises stainless steel.

13. The female terminal of claim 8 wherein the U-shaped clamping member is comprised of two or more separate spring members retained between different pairs of opposing beams.

14. The female terminal of claim 8 wherein the blade terminal has a first predetermined thickness, wherein each pair of opposing beams is separated by less than the first predetermined thickness while in their rest positions, wherein each pair of opposing beams have a second aggregate thickness in the area where they are contacted by respective end portions, and wherein the end portions disposed over respective opposing beams are separated by less than the sum of the first predetermined thickness and the second aggregate thickness while in their rest positions.

* * * * *